US012582255B2

(12) United States Patent
Webb

(10) Patent No.: US 12,582,255 B2
(45) Date of Patent: Mar. 24, 2026

(54) ADJUSTABLE SUSPENDABLE DECORATIVE ARTIFICIAL TREE SYSTEM AND ASSEMBLY FOR WINDOWS, CORNERS, AND WALLS

(71) Applicant: Barbara Webb, Raleigh, NC (US)

(72) Inventor: Barbara Webb, Raleigh, NC (US)

( * ) Notice: Subject to any disclaimer, the term of this patent is extended or adjusted under 35 U.S.C. 154(b) by 146 days.

(21) Appl. No.: 18/239,260

(22) Filed: Aug. 29, 2023

(65) Prior Publication Data

US 2025/0072643 A1 Mar. 6, 2025

(51) Int. Cl.
*A47G 33/06* (2006.01)

(52) U.S. Cl.
CPC ..... *A47G 33/06* (2013.01)

(58) Field of Classification Search
CPC ..... A47G 33/06
See application file for complete search history.

(56) References Cited

U.S. PATENT DOCUMENTS 4,968,541 A * 11/1990 McCrory ..... A47G 33/06 362/123
5,307,252 A * 4/1994 Croup ..... A47G 33/06 428/18
6,514,581 B1 * 2/2003 Gregory ..... A47G 33/06 D11/118
6,818,264 B1 * 11/2004 Samperisi, Jr. ..... A47G 33/12 428/18
2015/0272250 A1 * 10/2015 Chen ..... A47G 33/06 428/20

* cited by examiner

*Primary Examiner* — Kim S. Horger
(74) *Attorney, Agent, or Firm* — Origins Law, LLC; Nicholas Spatola

(57) ABSTRACT

An adjustable artificial Christmas tree configured to hang in a window or corner of a room. The tree incorporates innovative features that enable it to be easily adjusted for various heights, securely attached to a window frame or corner, and maintain stability during display. The tree's design ensures that it retains the appearance and charm of a traditional full-sized Christmas tree while offering enhanced placement options and versatility. The adjustable artificial tree assembly comprises a tree body having a plurality of vertical body extenders connected to one another by a connector between each vertical body extender, a plurality of adjustable tree branch brackets, at least one pair of vertically adjustable horizontal tree branch rods extending from each said adjustable tree branch bracket, a detachable base, and a hanging mechanism.

21 Claims, 21 Drawing Sheets

ADJUSTABLE SUSPENDABLE DECORATIVE ARTIFICIAL TREE SYSTEM AND ASSEMBLY FOR WINDOWS, CORNERS, AND WALLS

FIELD OF THE INVENTION

The present invention relates to artificial trees, and more specifically, to an adjustable artificial Christmas tree configured to hang in a window or corner of a room.

BACKGROUND

Traditional Christmas trees and traditional artificial Christmas trees are typically designed to stand upright on the floor, requiring a dedicated floor space and limiting their placement options. In certain situations, such as in small apartments or rooms with limited floor space, it can be challenging to accommodate a full-sized Christmas tree. Additionally, there may be instances where individuals desire a unique placement option, such as hanging the tree in a window or positioning it in a corner.

Various attempts have been made to address these limitations and provide alternative options for displaying Christmas trees. Some prior solutions include tabletop Christmas trees or wall-mounted decorations, but these often lack the grandeur and visual impact associated with traditional full-sized trees. Furthermore, existing hanging or corner-mounted Christmas tree designs have typically been limited in terms of adjustability, stability, or ease of setup and takedown. Rather, most are simply typical artificial trees that are suspended, or paper wall decorations that do not meet the typical expectation with a Christmas tree.

Therefore, there is a need for an improved adjustable artificial Christmas tree that overcomes the drawbacks of the currently available artificial Christmas trees, and artificial trees in general, and provides a versatile solution that can be conveniently hung in a window or positioned in a corner of a room while maintaining the aesthetic appeal and functionality of a full-sized tree.

SUMMARY OF THE INVENTION

The invention disclosed herein provides an adjustable artificial tree assembly. The adjustable artificial tree assembly comprises a tree body having a plurality of vertical body extenders connected to one another by a connector between each vertical body extender, a plurality of adjustable tree branch brackets, at least one pair of vertically adjustable horizontal tree branch rods extending from each said adjustable tree branch bracket, a detachable base, and a hanging mechanism.

The invention disclosed herein also provides a method for creating a customizable configuration of an artificial tree structure. The method comprises providing an adjustable artificial tree assembly having a tree body comprising a plurality of vertical body extenders connected to one another by a connector between each vertical body extender, a plurality of adjustable tree branch brackets, at least one pair of vertically adjustable horizontal tree branch rods extending from each said adjustable tree branch bracket, a detachable base, and a hanging mechanism.

It is an object of the present invention to provide a system capable of vertical adjustment to fit a plurality of installation conditions, including height, depth, and width restrictions.

It is yet another object of the present invention is to provide an artificial tree capable of standing and suspension in confined areas including, inter alia, a window frame and corners of rooms.

It is a further object to provide an artificial tree with enhanced ease of install and disassembly for routine use.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
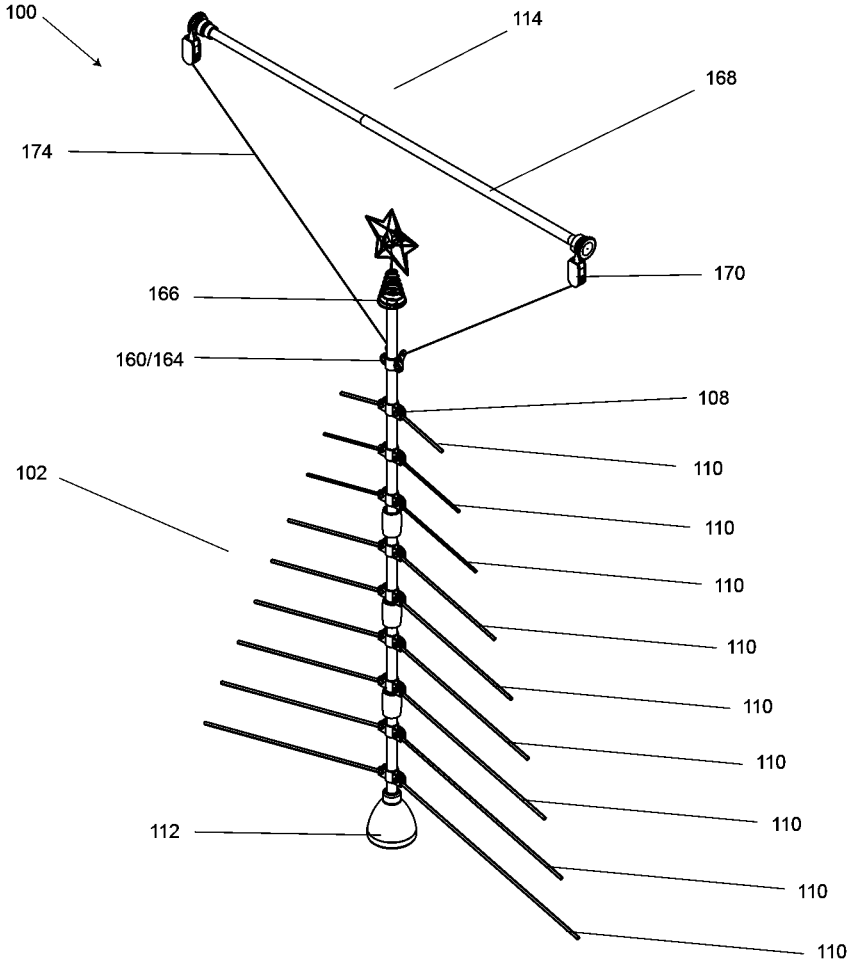
FIG. 1 illustrates an isometric view of an artificial tree assembly.

The invention herein provides a solution for inefficient artificial trees that cannot be mounted in various tight and height restricted locations. The invention includes a uniquely configured modular and adjustable shallow artificial tree capable of solving the above issues.

As stated above, traditional Christmas trees and traditional artificial Christmas trees are typically designed to stand upright on the floor, requiring a dedicated floor space and limiting their placement options. In certain situations, such as in small apartments or rooms with limited floor space, it can be challenging to accommodate a full-sized Christmas tree. Additionally, there may be instances where individuals desire a unique placement option, such as hanging the tree in a window or positioning it in a corner. Various attempts have been made to address these limitations and provide alternative options for displaying Christmas trees. Some prior solutions include tabletop Christmas trees or wall-mounted decorations, but these often lack the grandeur and visual impact associated with traditional full-sized trees. Furthermore, existing hanging or corner-mounted Christmas tree designs have typically been limited in terms of adjustability, stability, or ease of setup and takedown. Rather, most are simply typical artificial trees that are suspended, or paper wall decorations that do not meet the typical expectation with a Christmas tree.

The current invention also solves need for an improved adjustable artificial Christmas tree that overcomes the drawbacks of the currently available artificial Christmas trees, and artificial trees in general, and provides a versatile solution that can be conveniently hung in a window or positioned in a corner of a room while maintaining the aesthetic appeal and functionality of a full-sized tree.

The current invention solves these problems by providing an adjustable artificial Christmas tree configured to hang in a window or corner of a room. The tree incorporates innovative features that enable it to be easily adjusted for various heights, securely attached to a window frame or corner, and maintain stability during display. The tree's design ensures that it retains the appearance and charm of a traditional full-sized Christmas tree while offering enhanced placement options and versatility. By addressing the limitations of current artificial trees in the market, the adjustable artificial Christmas tree described herein provides users with a novel and convenient way to celebrate the holiday season. It allows individuals with limited floor space or those seeking unique display options to enjoy the beauty and festive spirit of a Christmas tree in their homes, offices, or any other suitable environment.

The current embodied invention utilizes variable configurations to fit different applications. Namely, the artificial tree includes cylindrical tube members, known as vertical body extenders, that form a vertical shaft mimicking the trunk and central crown support of a tree, and giving the tree height, as shown in FIGS. 3A-3E, the artificial tree has several modular vertical portions, wherein additional tubes may be added to increase height, or removed to decrease height. This is important to allow for broad application, as typical artificial trees come with a fixed height, typically selected by a user for a single location, whereas the artificial tree herein can be selectively adjusted depending on the location (for example, windows of different heights).

Shorter configurations may also be more structurally sound, and thus, may be assembled without the need for suspension support. For example, a 2 ft model can stand alone on any flat surface without the hanging support wires. The 2 ft model uses the same rubber footing base as a 4 ft model. To pare down to a 2 ft model, connectors for additional parts are removed leaving 4 hinged rods on either side to accommodate the appearance of full foliage. In some embodiments, the remaining top section becomes a 2 ft functioning pre-lit model with a single connector for power. This model is portable and can be erected on any flat stable surface. This model can also accommodate a topper. A 3 ft model can stand alone on any flat surface without the hanging support wires. The 3 ft model uses the same rubber footing base as the 4 ft model. To pare down to a 3 ft model, connectors are removed adding 4 additional hinged rods on either side to accommodate the appearance of full foliage. In some embodiments, the remaining top section becomes a 3 ft functioning pre-lit model with 2 connectors for lights and power. This model is portable. It can be positioned on any stable flat surface. This model can also accommodates a topper.

When the artificial tree requires suspension, an included tension rod compressively secures to parallel wall portions, such as in a window frame. The tension rod is configured to support the necessary weight of the tree to avoid tipping over. As is typical, the tension rod includes two hollow cylinders with an internal adjustment spring pushing each cylinder away from the other, thereby pressing on the two parallel walls. To connect the top of the tree to the tension rod, a connection mechanism is employed that secures to each distal end of the rod, and a line connects to two independent hooks configured to hook through a bracket at the top of the tree, providing torsional stability, which is not present in current suspended trees.

The line length may also be adjusted between the hooks and distal ends of the tension rod. As may be seen in FIGS. 1 and 2, the connectors coupling the line to the tension rods include cleats that the line wraps and ties around, whereby a cover is added once configured in length to protect the line from unraveling due to disturbance.

A unique connection module is also employed to couple each vertical body extender. The module includes a recessable stopper holder having a shaft configured to complementally recess into said recessable stopper cradle with an upper lip to keep said recessable stopper holder from passing completely through said open cylindrical body of said recessable stopper cradle, an adjustable stopper with an open cylindrical shaft and internal threading along said shaft, a threaded swivel end cap having a cylindrical upper area of engagement to recess up into each cylindrical tube and a lower external threading to engage complementally with said adjustable stopper's internal threading, a horizontal groove at a lower surface of said threaded end cap, recessing vertically upward into said threaded end cap, and a vertical tongue on an upper surface of said recessable stopper holder, wherein said vertical tongue engages with said horizontal groove recessing vertically upward into said threaded end cap, whereby once engaged, said tongue may rotatably influence adjustment within said adjustable stopper. As may be appreciated, these pieces nest together to form an adjustable coupling module, as may be seen particularly in FIG. 7C. It also allows for easy assembly, disassembly, and adjustment.

With the vertical superstructure constructed, branches may be added in. Branches adopt the form of foliage on a central rod. The rods have a connection area at a base, which may for a cylindrical form with hole in the center, like a doughnut, whereby a securement pin may be added to allow the branches the ability to rotate about the pin for vertical adjustment. It should be appreciated that in embodiments where no rotatable adjustment is needed, the branches may fix directly into the brackets or cylindrical body. In the embodiment shown in FIG. 1, the rods may rest on a shelf-like structure to prevent the branches from dipping below a predetermined positioning. In addition, shelves may be straight or in some cases, obtuse to allow the artificial tree to accommodate flat windows and corners while also appearing full.

The adjustable suspendable decorative artificial tree system and assembly for windows corners, and walls of the present invention may be used to provide a system capable of vertical adjustment to fit a plurality of installation conditions, including height, depth, and width restrictions, provide an artificial tree capable of standing and suspension in confined areas including, inter alia, a window frame and corners of rooms, and provide an artificial tree with enhanced ease of install and disassembly for routine use. This apparatus, system, and method are particularly shown in FIGS. 1-15B.

FIG. 1 illustrates an isometric view of an artificial tree assembly 100. Shown in Also shown in FIG. 1 are tree body 102, adjustable tree branch brackets 108, vertically adjustable horizontal tree branch rods 110, a detachable base 112, hanging mechanism 114, tree suspension bracket 160/topmost tree extension bracket 164, top 166 of the tree body 102, tension rod 168, suspended hooks 170, and suspension line 174.

Figure 2:
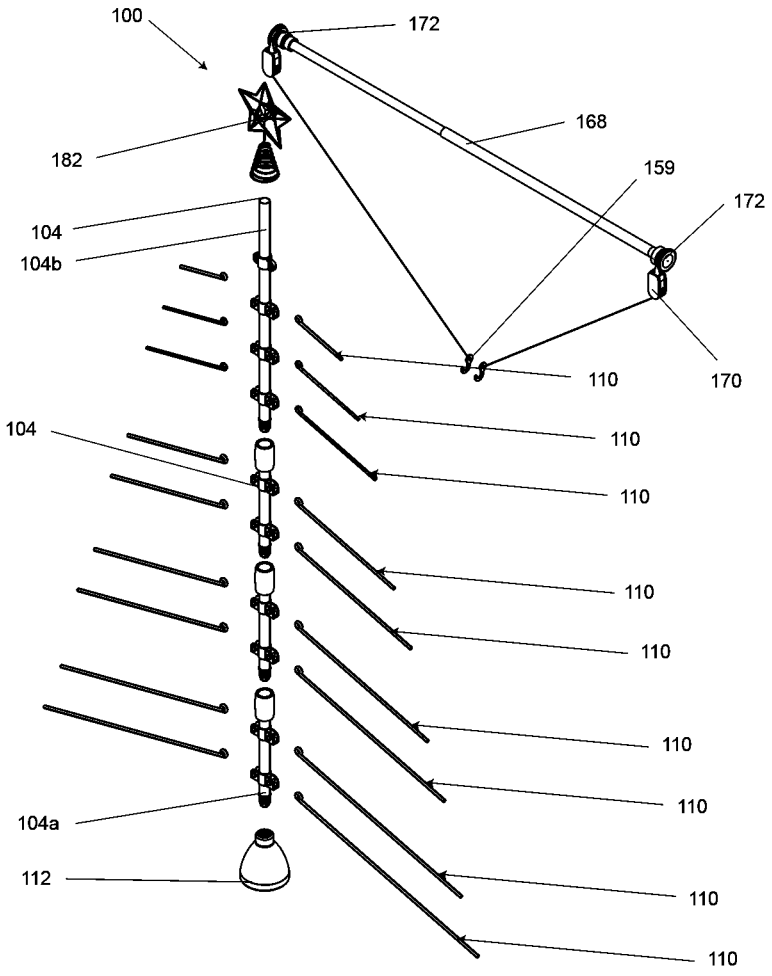
FIG. 2 illustrates an exploded isometric view of the artificial tree assembly.

FIG. 2 illustrates an exploded isometric view of the artificial tree assembly 100. Also shown in FIG. 2 are a plurality of vertical body extenders 104, including a lowermost vertical body extender 104*a* and an upper vertical body extender 104*b*, vertically adjustable horizontal tree branch rods 110, detachable base 112, a pair of hooks 159, tension rod 168, suspended hooks 170, distal ends 172 of said tension rod, and top star 182.

Figure 3A:
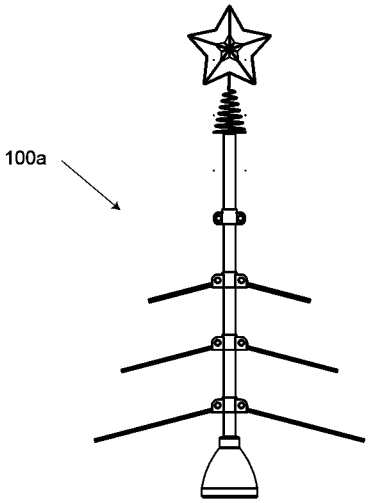
FIG. 3A illustrates a front view of a small artificial tree assembly.
Figure 3B:
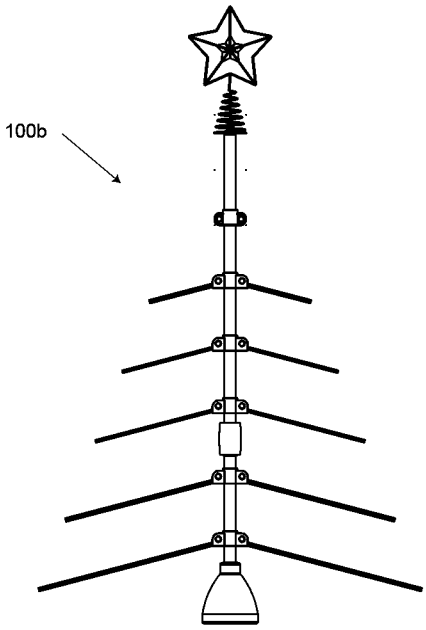
FIG. 3B illustrates a front view of a medium artificial tree assembly.
Figure 3C:
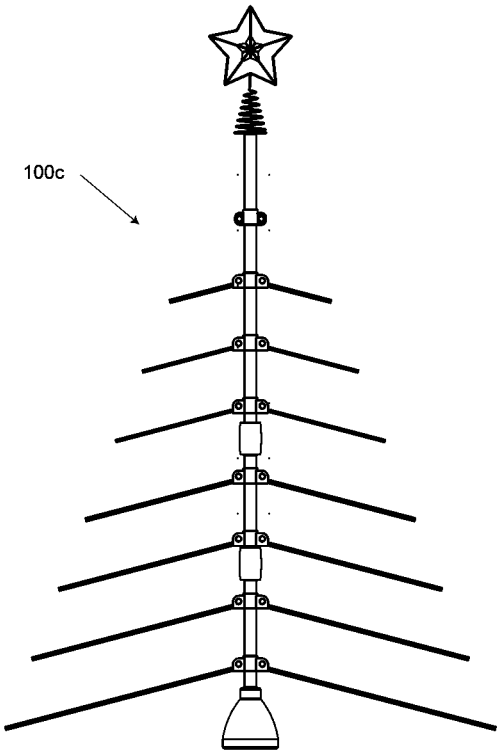
FIG. 3C illustrates a front view of a large artificial tree assembly.
Figure 3D:
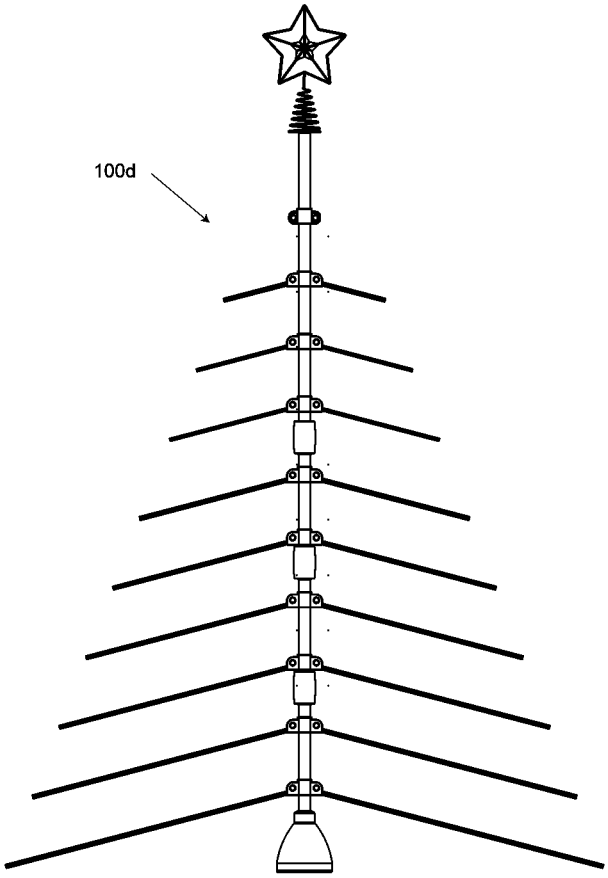
FIG. 3D illustrates a front view of a full-size artificial tree assembly.
Figure 3E:
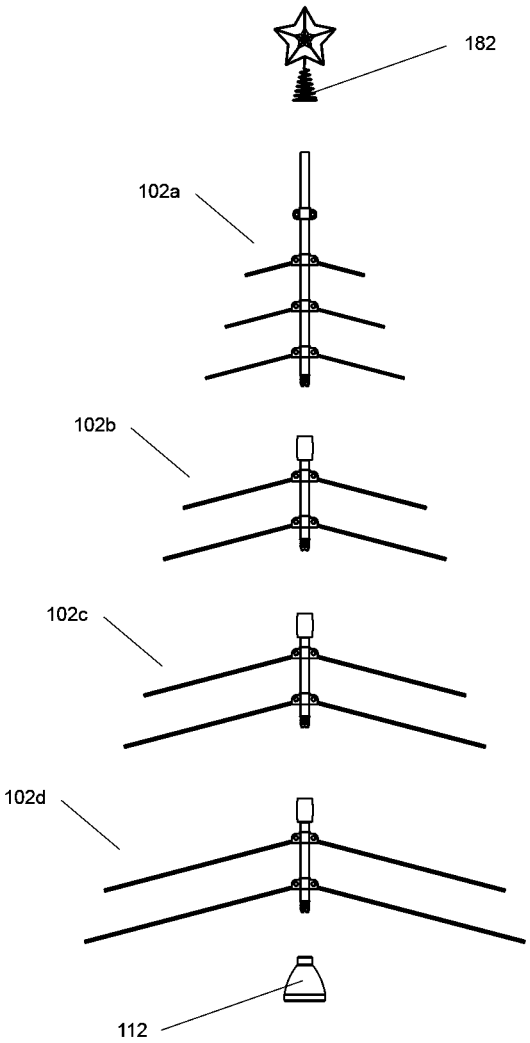
FIG. 3E illustrates a front view of a partially-exploded artificial tree assembly, showing the different extension segments.

FIG. 3A illustrates a front view of a small artificial tree assembly 100*a*. FIG. 3B illustrates a front view of a medium artificial tree assembly 100*b*. FIG. 3C illustrates a front view of a large artificial tree assembly 100*c*. FIG. 3D illustrates a front view of a full-size artificial tree assembly 100*d*. FIG. 3E illustrates a front view of a partially-exploded artificial tree assembly, showing the different extension segments: the topmost segment 102*a* the second segment 102*b* the third segment 102*c*, and the lowermost segment 102*d*. Further shown are the base 112 and top star 182.

Figure 4:
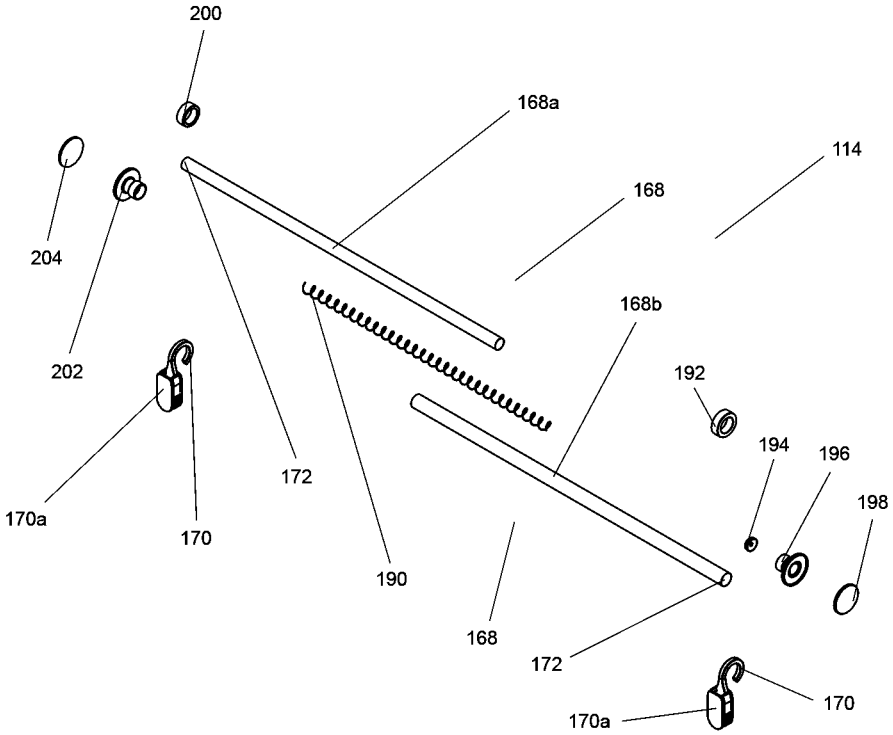
FIG. 4 illustrates an exploded isometric view of a hanging mechanism.

FIG. 4 illustrates an exploded isometric view of a hanging mechanism 114. Also shown in FIG. 4 are two hollow cylinders 168*a*/168*b*, tension rod 168, hooks cover 170*a*, suspended hooks 170, distal end 172 of said tension rod, internal adjustment spring 190, tension rod stopper 192, mechanism internal stopper 194, wall holder 196, wall stopper 198, tension rod stopper 200, wall holder 202, and wall stopper 204.

Figure 5A:
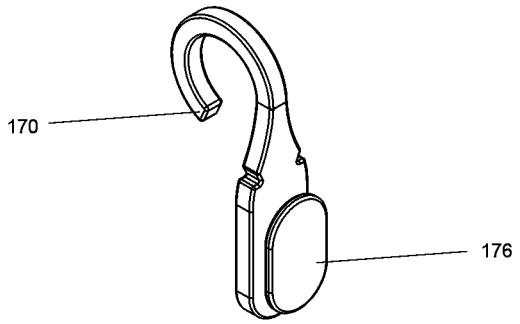
FIG. 5A illustrates an enlarged isometric view of the of a tension rod line connector of the hanging mechanism.
Figure 5B:
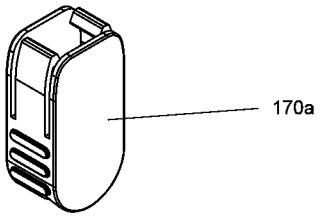
FIG. 5B illustrates an enlarged isometric view of a cover of the tension rod line connector of the hanging mechanism.

FIG. 5A illustrates an enlarged isometric view of the of a tension rod line connector 170 of the hanging mechanism 114, and engageable mounting area cleat 176 for attaching suspension line. FIG. 5B illustrates an enlarged isometric view of a cover 170*a* of the tension rod line connector 170 of the hanging mechanism 114.

Figure 6A:
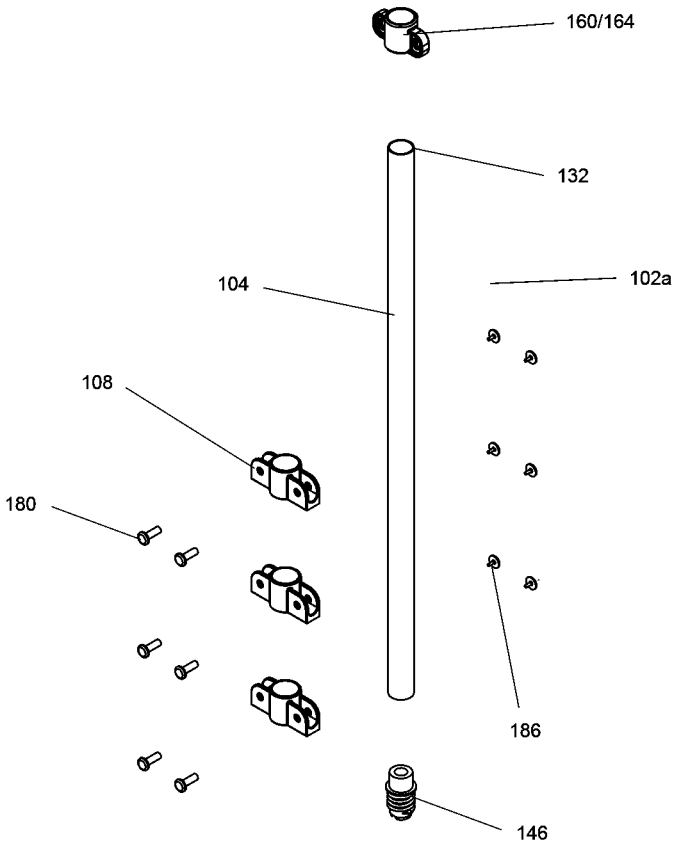
FIG. 6A illustrates an exploded isometric view of a topmost vertical body extender of the artificial tree assembly.
Figure 6B:
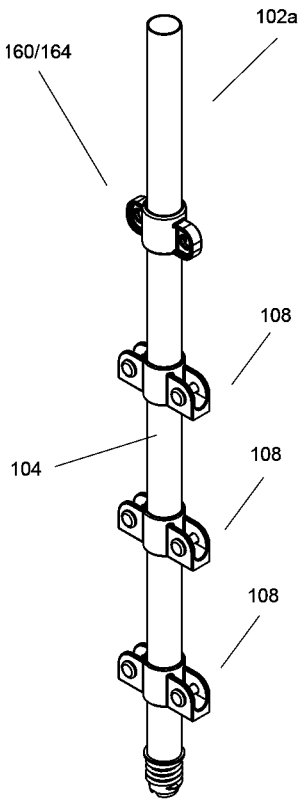
FIG. 6B illustrates an isometric view of the topmost vertical body extender of the artificial tree assembly.
Figure 6C:
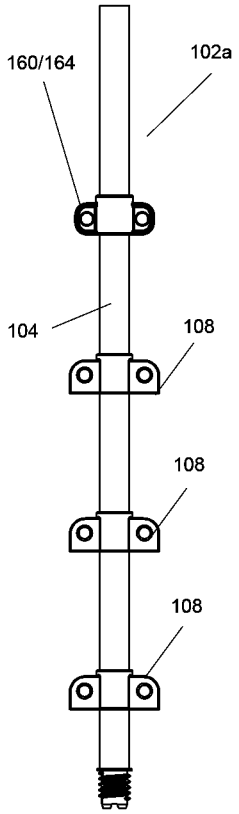
FIG. 6C illustrates a front view of the topmost vertical body extender of the artificial tree assembly.
Figure 6D:
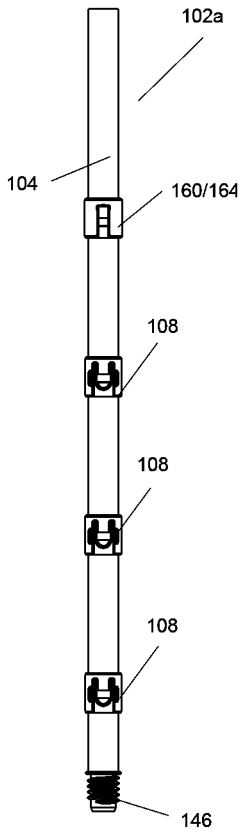
FIG. 6D illustrates a side view of the topmost vertical body extender of the artificial tree assembly.

FIG. 6A illustrates an exploded isometric view of a topmost vertical body extender 102*a* of the artificial tree assembly 100. FIG. 6B illustrates an isometric view of the topmost vertical body extender 102*a* of the artificial tree assembly 100. FIG. 6C illustrates a front view of the topmost vertical body extender 102*a* of the artificial tree assembly 100. FIG. 6D illustrates a side view of the topmost vertical body extender 102*a* of the artificial tree assembly 100. Also shown in FIGS. 6A-6D are plurality of vertical body extenders 104, adjustable tree branch brackets 108, an open upper end 132, threaded swivel end cap 146, tree suspension bracket 160/topmost tree extension bracket 164, bracket pin 180, and pin stopper 186.

Figure 7A:
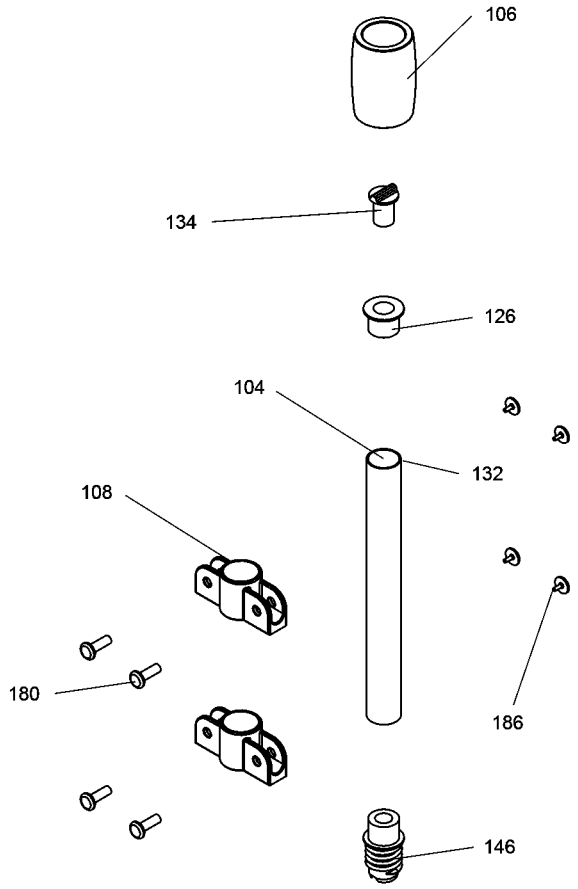
FIG. 7A illustrates an exploded isometric view of a vertical body extender of the artificial tree assembly.
Figure 7B:
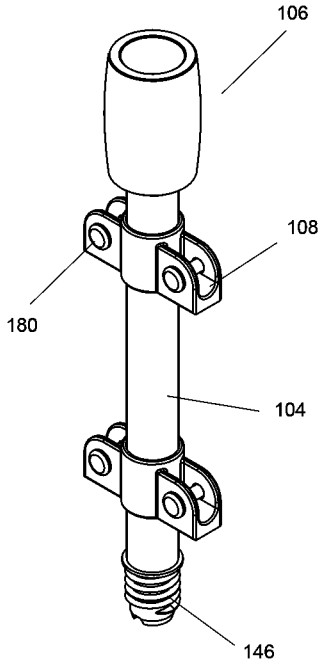
FIG. 7B illustrates an isometric view of the vertical body extender of the artificial tree assembly.
Figure 7C:
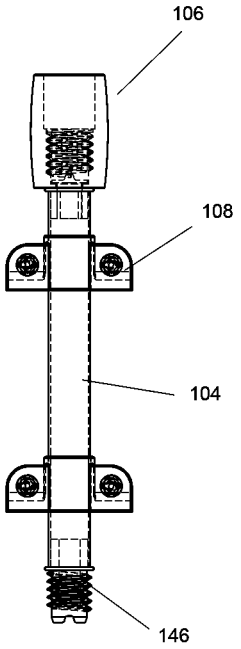
FIG. 7C illustrates a front view of the vertical body extender of the artificial tree assembly.

FIG. 7A illustrates an exploded isometric view of a vertical body extender 104 of the artificial tree assembly 100. FIG. 7B illustrates an isometric view of the vertical body extender 104 of the artificial tree assembly 100. FIG. 7C illustrates a front view of the vertical body extender 104 of the artificial tree assembly 100. Also shown in FIGS. 7A-7C are connector 106, adjustable tree branch brackets 108, recessable stopper cradle 126, an open upper end 132, recessable stopper holder 134, threaded swivel end cap 146, bracket pin 180, and pin stopper 186.

Figure 8:
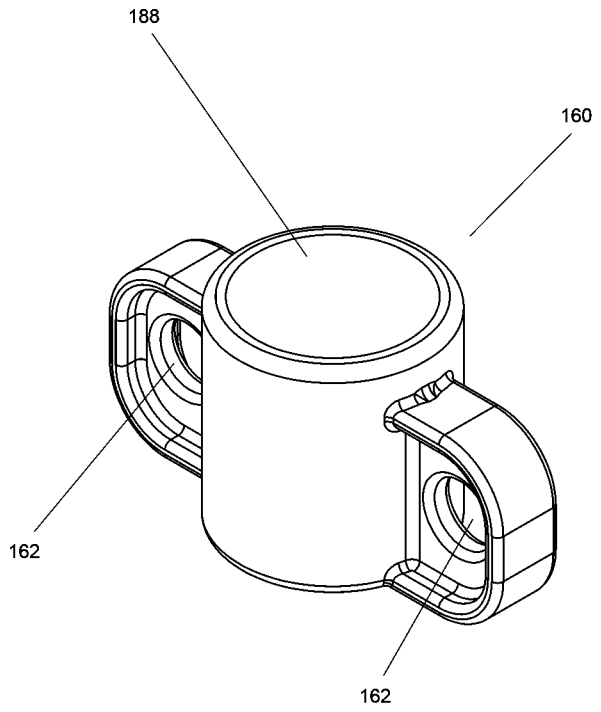
FIG. 8 illustrates an isometric view of a tree suspension bracket.

FIG. 8 illustrates an isometric view of a tree suspension bracket 160. Also shown in FIG. 8 are through-holes 162 and central shaft 188.

Figure 9:
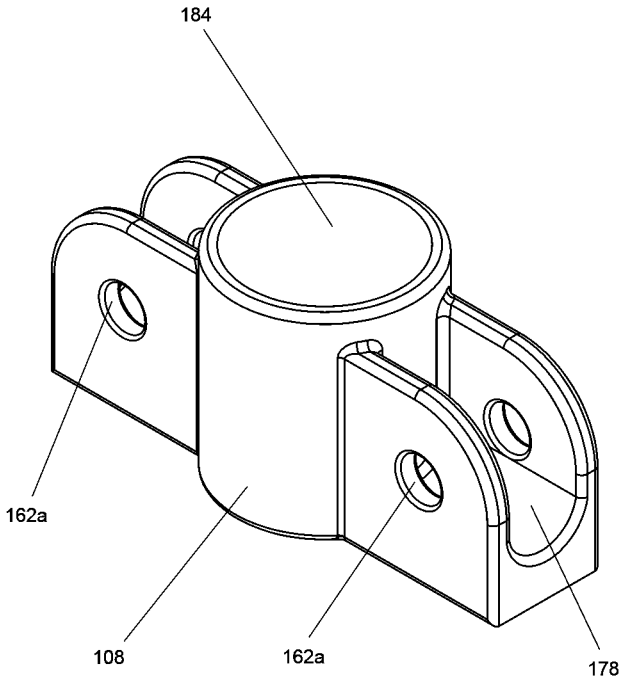
FIG. 9 illustrates an isometric view of an adjustable tree branch bracket.

FIG. 9 illustrates an isometric view of an adjustable tree branch bracket 108. Also shown in FIG. 9 are apertures 162*a*, lower shelf 178, and central shaft 184.

Figure 10A:
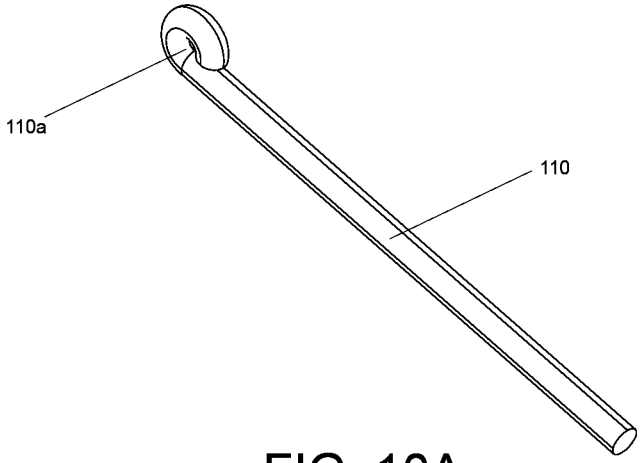
FIG. 10A illustrates an isometric view of a vertically adjustable horizontal tree branch rod.
Figure 10B:
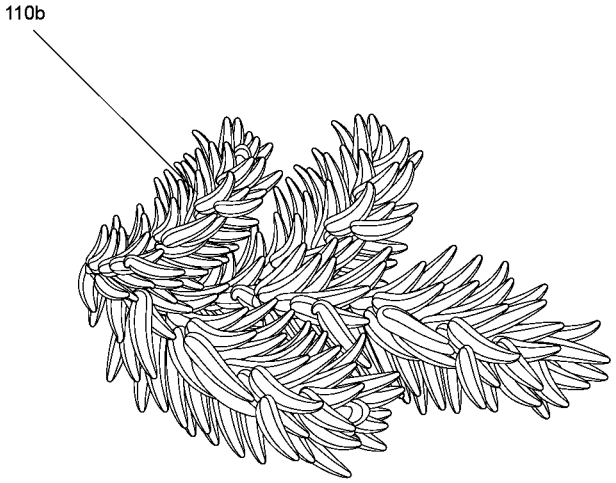
FIG. 10B illustrates an isometric view of the vertically adjustable horizontal tree branch rod covered in foliage.

FIG. 10A illustrates an isometric view of a vertically adjustable horizontal tree branch rod 110 with branch aperture 110*a*. FIG. 10B illustrates an isometric view of the vertically adjustable horizontal tree branch rod covered in foliage 110*b*.

Figure 11A:
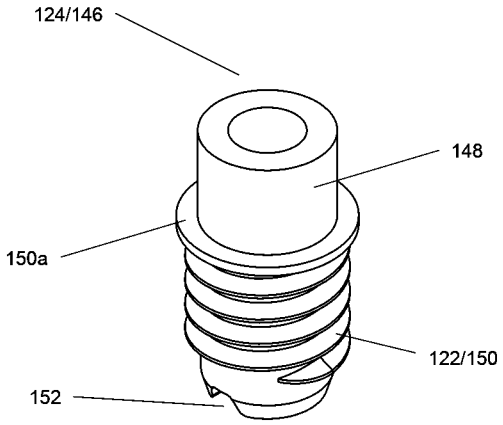
FIG. 11A illustrates an isometric view of a threaded swivel end cap.
Figure 11B:
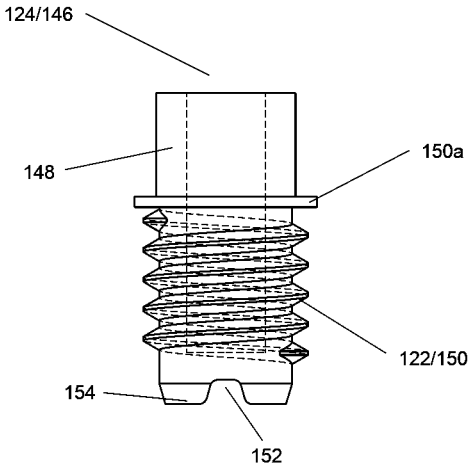
FIG. 11B illustrates a side view of the threaded swivel end cap with internal structure shown in phantom lines.

FIG. 11A illustrates an isometric view of a threaded swivel end cap 124/146. FIG. 11B illustrates a side view of the threaded swivel end cap 124/146 with internal structure shown in phantom lines. Also shown in FIGS. 11A-11B are cylindrical upper area of engagement 148, external threading lip 150*a*, a lower external threading 122/150, horizontal groove 152, which exists at a lower surface 154.

Figure 12A:
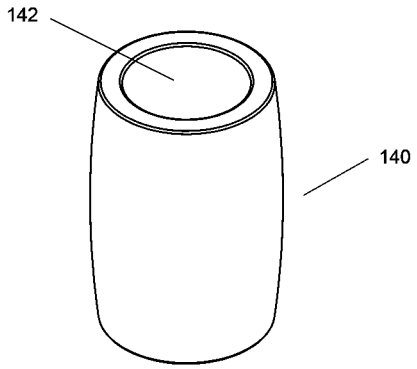
FIG. 12A illustrates an isometric view of an adjustable stopper.
Figure 12B:
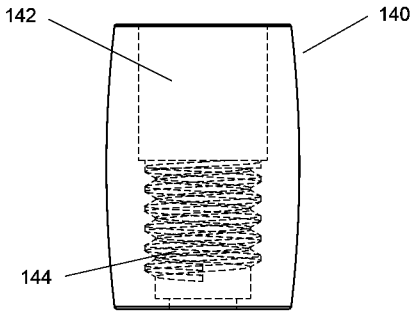
FIG. 12B illustrates a side view of the adjustable stopper, with internal structure shown in phantom lines.

FIG. 12A illustrates an isometric view of an adjustable stopper 140. FIG. 12B illustrates a side view of the adjustable stopper 140, with internal structure shown in phantom lines. Also shown in FIGS. 12A-12B are an open cylindrical shaft 142 and internal threading 144.

Figure 13A:
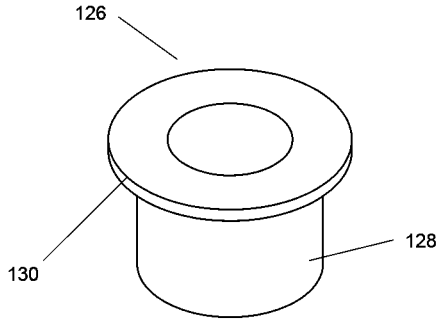
FIG. 13A illustrates an isometric view of a recessable stopper cradle.
Figure 13B:
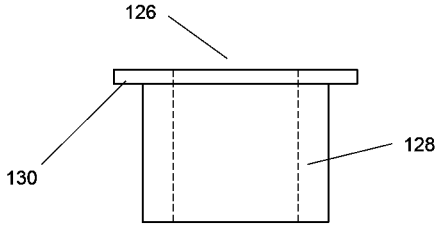
FIG. 13B illustrates a side view of the recessable stopper cradle, with internal structure shown in phantom lines.

FIG. 13A illustrates an isometric view of a recessable stopper cradle 126. FIG. 13B illustrates a side view of the recessable stopper cradle 126, with internal structure shown in phantom lines. Also shown in FIGS. 13A-13B are open cylindrical body 128 and upper lip 130.

Figure 14:
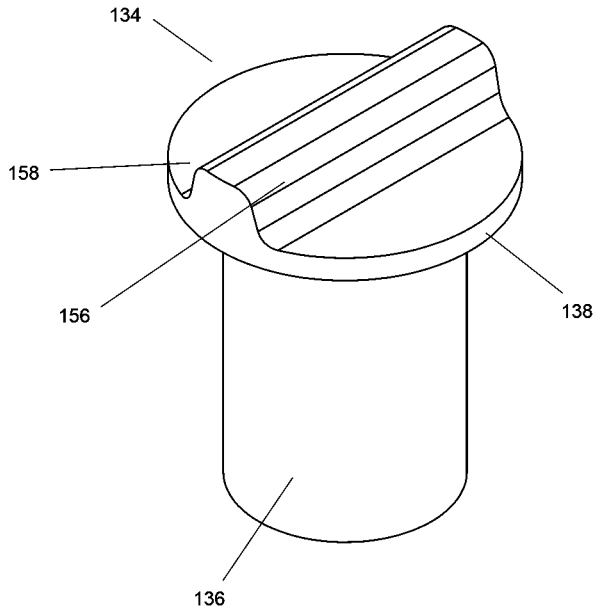
FIG. 14 illustrates an isometric view of a recessable stopper holder.

FIG. 14 illustrates an isometric view of a recessable stopper holder 134. Also shown in FIG. 14 are shaft 136, an upper lip 138, a vertical tongue 156, and an upper surface 158.

Figure 15A:
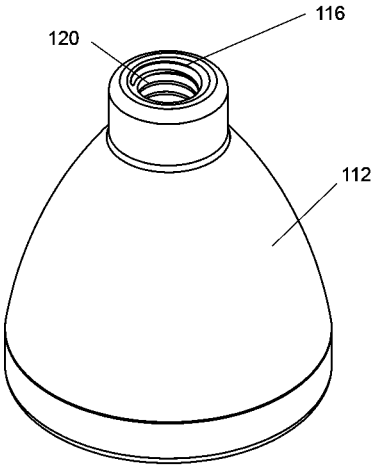
FIG. 15A illustrates an isometric view of a detachable base.
Figure 15B:
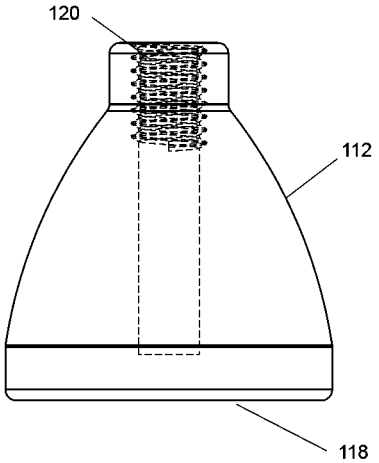
FIG. 15B illustrates a side view of the detachable base, with internal structure shown in phantom lines.

FIG. 15A illustrates an isometric view of a detachable base 112. FIG. 15B illustrates a side view of the detachable base 112, with internal structure shown in phantom lines. Also shown in FIGS. 15A-15B are upper open socket 116, a lower surface 118, and internal threading 120.

In an exemplary embodiment, an adjustable artificial tree assembly 100, is provided. The adjustable artificial tree assembly 100 comprises a tree body 102 having a plurality of vertical body extenders 104 connected to one another by a connector 106 between each vertical body extender 104. The adjustable artificial tree assembly 100 also includes a plurality of adjustable tree branch brackets 108, at least one pair of vertically adjustable horizontal tree branch rods 110 extending from each said adjustable tree branch bracket 108, a detachable base 112, and a hanging mechanism 114.

In some embodiments, the detachable base 112 includes an upper open socket 116 for receiving a lowermost vertical body extender 104*a*. The detachable base 112 provides a lower surface 118 having a larger surface area than said upper open socket 116 surface area. The detachable base 112 may be weighted and comprise a weighted material to assist with securing the artificial tree assembly 100 from moving when installed. The detachable base 112 may also be formed from rubber, thereby providing grip and resiliency. Further, in some embodiments, the detachable base 112 has internal threading 120 inside said upper open socket 116 to engage with the external threading 122 of the threaded swivel end cap 124.

While alternatives may exist, in some embodiments, the body extender 104 may be a cylindrical tube, providing for reduces weight and material requirements in the manufacturing process.

In some embodiments, the connector 106 between each vertical body extender 104 is comprised of several components working together as a nested connector module 106. This module includes a recessable stopper cradle 126 comprising an open cylindrical body 128 with an upper lip 130, wherein said recessable stopper cradle 126 partially recesses into an open upper end 132 of said cylindrical tube body extender 104. The connector module 106 also includes a recessable stopper holder 134 having a shaft 136 configured to complementally recess into said recessable stopper cradle 126 with an upper lip 138 to keep said recessable stopper holder 134 from passing completely through said open cylindrical body 128 of said recessable stopper cradle 126. The module 106 also includes an adjustable stopper 140 with an open cylindrical shaft 142 and internal threading 144 along said shaft 142. The module 106 includes a threaded swivel end cap 146. The threaded swivel cap 146 has a cylindrical upper area of engagement 148 to recess up into each cylindrical tube 104 and a lower external threading 150 to engage complementally with said adjustable stopper's internal threading 144. A horizontal groove 152 exists at a lower surface 154 of said threaded end cap 146, recessing vertically upward into said threaded end cap 146, and a vertical tongue 156 is present on an upper surface 158 of said recessable stopper holder 134, wherein said vertical tongue 156 engages with said horizontal groove 152 recessing vertically upward into said threaded end cap 146, whereby once engaged, said tongue 156 may rotatably influence adjustment within said adjustable stopper 140.

In an exemplary embodiment, the hanging mechanism 113 may include at least a pair of hooks 159, and a tree suspension bracket 160 configured to affix to an upper vertical body extender 104*b*, wherein said tree suspension bracket 160 includes through-holes 162 to engage with said hooks 159 of said hanging mechanism 114. The tree suspension bracket 160 may be a topmost tree extension bracket 164 to help keep the stability of the top of the tree 166 from tipping.

In some embodiments, the hanging mechanism 114 further comprises a tension rod 168 configured to provide compressive pressure against parallel vertical walls of a window frame, thereby allowing a pair of suspended hooks 159, of said at least a pair of hooks, coupled at each respective distal end 172 of said tension rod 168 to hook through a pair of apertures 162 in said tree suspension bracket 160. The pair of suspended hooks 150 are suspended using a line 174. The line 174 may be selected from a group of suspending lines including wire, cord, and thread. The tension rod 168 is coupled to said line 174 by mounting hooks 170, which grab the cylindrical shape of the tension rod 168, as may be appreciated in FIGS. 1-2 and 4-5, and provides an engageable mounting area cleat 176 for said line 174.

In some embodiments, the at least one suspension bracket 160 defines a plurality of suspension brackets 160, whereby a topmost suspension bracket 164 is configured to receive a pair of hooks 159 from a hanging mechanism 114, and intermediate brackets are adjustable tree branch brackets 108, and are configured to receive a vertically adjustable horizontal tree branch rod 110, as part of the plurality of vertically adjustable horizontal tree branch rods, at each aperture 162*a*. Stated another way, in some embodiments, the suspension brackets and the adjustable tree branch brackets both include apertures at extending sides, as shown in FIGS. 8 and 9, and therefore, in some embodiments the tree assembly may come with a single style of bracket to minimize the number of varying parts.

In some embodiments, the intermediate brackets 108 have a lower shelf 178 formed into said bracket 108 to vertically contain each of said vertically adjustable horizontal tree branch rods 110. The lower shelf 178 and apertures 162*a* may all be angled less than or equal to 180-degrees, as shown in FIGS. 1 and 2, to provide a form-factor capable of abutting a window, wall, or corner. In some embodiments, each vertically adjustable horizontal tree branch rod 110 is secured to an aperture 162*a* in said adjustable tree branch bracket 108 by a bracket pin 180. Each bracket pin 180 may allow vertical adjustability.

In addition to the exemplary physical embodiments, a method for creating a customizable configuration of an artificial tree structure, is also provided. The method comprises providing an adjustable artificial tree assembly 100, as shown and described, having a tree body 102 comprising a plurality of vertical body extenders 104 connected to one another by a connector 106 between each vertical body extender 104, a plurality of adjustable tree branch brackets 108, at least one pair of vertically adjustable horizontal tree branch rods 110 extending from each said adjustable tree branch bracket 108, a detachable base 112, and a hanging mechanism 114.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. An adjustable artificial tree assembly, comprising:

a tree body comprising a plurality of vertical body extenders connected to one another by a connector between each vertical body extender;

a plurality of adjustable tree branch brackets;

at least one pair of vertically adjustable horizontal tree branch rods extending from each said adjustable tree branch bracket;

a detachable base; and a hanging mechanism, wherein said hanging mechanism includes:

at least a pair of hooks; and a tree suspension bracket configured to affix to an upper vertical body extender, wherein said tree suspension bracket includes through-holes to engage with said hooks of said hanging mechanism.

2. The adjustable artificial tree assembly, as recited in claim 1, wherein said detachable base includes:

an upper open socket for receiving a lowermost vertical body extender, of said plurality of vertical body extenders; and said detachable base provides a lower surface having a larger surface area than said upper open socket surface area.

3. The adjustable artificial tree assembly, as recited in claim 1, wherein said detachable base comprises a weighted material to assist with securing the artificial tree assembly from moving when installed.

4. The adjustable artificial tree assembly, as recited in claim 1, wherein said detachable base is formed from rubber, thereby providing grip and resiliency.

5. The adjustable artificial tree assembly, as recited in claim 1, wherein each of body extender is a cylindrical tube.

6. An adjustable artificial tree assembly, comprising:

a tree body comprising a plurality of vertical body extenders connected to one another by a connector between each vertical body extender;

a plurality of adjustable tree branch brackets;

at least one pair of vertically adjustable horizontal tree branch rods extending from each said adjustable tree branch bracket;

a detachable base;

a hanging mechanism;

wherein each of body extender is a cylindrical tube; and wherein the connector between each vertical body extender is comprised of:

a recessable stopper cradle comprising an open cylindrical body with an upper lip, wherein said recessable stopper cradle partially recesses into an open upper end of said cylindrical tube;

a recessable stopper holder having a shaft configured to complementally recess into said recessable stopper cradle with an upper lip to keep said recessable stopper holder from passing completely through said open cylindrical body of said recessable stopper cradle;

an adjustable stopper with an open cylindrical shaft and internal threading along said shaft;

a threaded swivel end cap having a cylindrical upper area of engagement to recess up into each cylindrical tube and a lower external threading to engage complementally with said adjustable stopper's internal threading;

a horizontal groove at a lower surface of said threaded end cap, recessing vertically upward into said threaded end cap; and a vertical tongue on an upper surface of said recessable stopper holder, wherein said vertical tongue engages with said horizontal groove recessing vertically upward into said threaded end cap, whereby once engaged, said tongue may rotatably influence adjustment within said adjustable stopper.

7. The adjustable artificial tree assembly, as recited in claim 6, wherein said detachable base includes an upper open socket for receiving a lowermost vertical body extender, of said plurality of vertical body extenders; said said detachable base provides a lower surface having a larger surface area than said upper open socket surface area.

8. The adjustable artificial tree assembly, as recited in claim 7, wherein said detachable base has internal threading inside said upper open socket to engage with the external threading of the threaded swivel end cap.

9. The adjustable artificial tree assembly, as recited in claim 6, wherein said hanging mechanism includes:

at least a pair of hooks; and a tree suspension bracket configured to affix to an upper vertical body extender, wherein said tree suspension bracket includes through-holes to engage with said hooks of said hanging mechanism.

10. The adjustable artificial tree assembly, as recited in claim 1, wherein said tree suspension bracket is a topmost tree extension bracket.

11. The adjustable artificial tree assembly, as recited in claim 1, wherein said hanging mechanism further comprises:

a tension rod configured to provide compressive pressure against parallel vertical walls of a window frame, thereby allowing a pair of suspended hooks, of said at least a pair of hooks, coupled at each respective distal end of said tension rod to hook through a pair of apertures in said tree suspension bracket.

12. The adjustable artificial tree assembly, as recited in claim 11, wherein said pair of suspended hooks are suspended using a line, said line being selected from a group of suspending lines comprised of wire, cord, and thread.

13. The adjustable artificial tree assembly, as recited in claim 12, wherein said tension rod is coupled to said line by mounting hooks, which grab the cylindrical shape of the tension rod, and provide an engageable mounting area cleat for said cord.

14. The adjustable artificial tree assembly, as recited in claim 1, wherein said at least one suspension bracket defines a plurality of suspension brackets, whereby a topmost suspension bracket is configured to receive a pair of hooks from a hanging mechanism, and intermediate brackets are configured to receive a vertically adjustable horizontal tree branch rod, of said plurality of vertically adjustable horizontal tree branch rods, at each aperture.

15. The adjustable artificial tree assembly, as recited in claim 14, wherein said intermediate brackets have a lower shelf formed into said bracket to vertically contain each of said vertically adjustable horizontal tree branch rods.

16. The adjustable artificial tree assembly, as recited in claim 15, wherein said lower shelf and apertures are all angled less than or equal to 180-degrees to provide a form-factor capable of abutting a window, wall, or corner.

17. The adjustable artificial tree assembly, as recited in claim 1, wherein a lower shelf and apertures are all angled less than or equal to 180-degrees to provide a form-factor capable of abutting a window, wall, or corner.

18. The adjustable artificial tree assembly, as recited in claim 1, wherein each vertically adjustable horizontal tree branch rod is secured to an aperture in said adjustable tree branch bracket by a bracket pin.

19. The adjustable artificial tree assembly, as recited in claim 18, wherein each bracket pin may allow vertical adjustability.

20. A method for creating a customizable configuration of an artificial tree structure, comprising:

providing an adjustable artificial tree assembly, having:

a tree body comprising a plurality of vertical body extenders connected to one another by a connector between each vertical body extender;

a plurality of adjustable tree branch brackets;

at least one pair of vertically adjustable horizontal tree branch rods extending from each said adjustable tree branch bracket;

a detachable base; and a hanging mechanism, wherein said hanging mechanism includes:

at least a pair of hooks; and a tree suspension bracket configured to affix to an upper vertical body extender, wherein said tree suspension bracket includes through-holes to engage with said hooks of said hanging mechanism.

21. A method for creating a customizable configuration of an artificial tree structure, comprising:

providing an adjustable artificial tree assembly, having:

a tree body comprising a plurality of vertical body extenders connected to one another by a connector between each vertical body extender;

a plurality of adjustable tree branch brackets;

at least one pair of vertically adjustable horizontal tree branch rods extending from each said adjustable tree branch bracket;

a detachable base;

a hanging mechanism;

wherein each of body extender is a cylindrical tube; and wherein the connector between each vertical body extender is comprised of:

a recessable stopper cradle comprising an open cylindrical body with an upper lip, wherein said recessable stopper cradle partially recesses into an open upper end of said cylindrical tube;

a recessable stopper holder having a shaft configured to complementally recess into said recessable stopper cradle with an upper lip to keep said recessable stopper holder from passing completely through said open cylindrical body of said recessable stopper cradle;

an adjustable stopper with an open cylindrical shaft and internal threading along said shaft;

a threaded swivel end cap having a cylindrical upper area of engagement to recess up into each cylindrical tube and a lower external threading to engage complementally with said adjustable stopper's internal threading;

a horizontal groove at a lower surface of said threaded end cap, recessing vertically upward into said threaded end cap; and a vertical tongue on an upper surface of said recessable stopper holder, wherein said vertical tongue engages with said horizontal groove recessing vertically upward into said threaded end cap, whereby once engaged, said tongue may rotatably influence adjustment within said adjustable stopper.

* * * * *